United States Patent [19]

Caccavale

[11] 4,443,956

[45] Apr. 24, 1984

[54] SHOE REPLACEABLE HEEL KIT

[76] Inventor: Albert Caccavale, 215B Faller Dr., New Milford, N.J. 07646

[21] Appl. No.: 421,447

[22] Filed: Sep. 22, 1982

[51] Int. Cl.[3] ..... A43B 21/38; A43B 21/36

[52] U.S. Cl. ..... 36/36 R; 36/41; 36/42

[58] Field of Search ..... 36/36 R, 36 A, 36 B, 36/36 C, 41, 42, 35 A, 72 B, 73

[56] References Cited

U.S. PATENT DOCUMENTS

| | | | |
|---|---|---|---|
| 77,055 | 4/1868 | Lane | 36/41 |
| 691,857 | 1/1902 | Hansen | 36/41 |
| 1,356,829 | 10/1920 | Rohmer | 36/36 R |
| 3,034,234 | 5/1962 | Portelli | 36/36 R |
| 4,198,770 | 4/1980 | Orea Mateo | 36/42 |
| 4,363,177 | 12/1982 | Boros | 36/42 |

FOREIGN PATENT DOCUMENTS

| | | | |
|---|---|---|---|
| 757163 | 12/1933 | France | 36/42 |

*Primary Examiner*—Werner H. Schroeder
*Assistant Examiner*—Steven N. Meyers
*Attorney, Agent, or Firm*—Richard L. Miller

[57] ABSTRACT

A shoe replaceable heel device including a heel base including a replaceable heel mounted on the bottom of the heel portion of the sole of a shoe, a replaceable heel connecting means for removably screwing said replaceable heel to the underside of the heel base and fastening means for securing the heel base to the sole. The connecting means includes a circular base plate secured to the underside of the heel base and a circular replaceable plate secured to the top of said replaceable heel. The base plate has a male threaded perimeter and the replaceable plate has female screw threads adapted to mate with the threaded perimeter of the base plate. The connecting means for women's replaceable high heel is to secure base plate directly to heel portion of shoe sole and apply fastening means described. Included in women's replaceable high heel is a replaceable lift device, including a lift base plate fastened at the heel tip, having a female screw insert mounted therein and a male screw removably screwed into said female screw insert, said male screw being provided with replaceable lift for said female lift base plate.

3 Claims, 8 Drawing Figures

SHOE REPLACEABLE HEEL KIT

BACKGROUND OF THE INVENTION

The present invention relates generally to the repair of heels of shoes and more specifically to the convenient and economical replacement of a worn heel by the shoe wearer.

It is well known that a high portion of the cost of replacing a worn heel is the labor cost of the shoe repairman, who must charge not only for his time and expertise but also for the investment and maintenance cost of his machinery and shop.

The present invention relates further to the direct application into the manufacturing of new shoes, which will feature the introduction of the sale of "spare heels" with every pair of new shoes sold.

SUMMARY OF THE INVENTION

Therefore it is a principal object of the present invention to provide a device for shoes that allows the wearer to easily remove a worn heel from a shoe and replace it with a new heel.

It is a further object of the present invention to provide a device for replacing a heel that allows a user to unscrew a used heel from a shoe and to screw on a new heel.

It is yet another object of the present invention to provide a circular base plate secured to the heel base of a shoe adapted to receive a circular replaceable plate secured to a leather, rubber or suitable material heel, the replaceable plate being adapted to be screwed onto the base plate.

It is yet a further object of the present invention to provide a shoe with a heel base having a metal or suitable material base plate that is adapted to have a heel having a metal, or suitable material replaceable plate screwed to or unscrewed from it, the heel base being secured to the heel portion of the shoe by a planar member by means of at least one RIVNUT®.

It is a further object of the present invention to provide a woman's high heel shoe with a replaceable high heel base that can be removably screwed onto the heel base plate fastened directly to sole heel portion of the shoe.

It is yet a further object of the present invention to provide a replaceable high heel base for a woman's shoe that is also provided with replaceable heel lifts that can be replaceable screwed to the lift base plate at the heel tip.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF PREFERRED EMBODIMENTS

Reference is now made in greater detail to the drawings.

Figure 1:
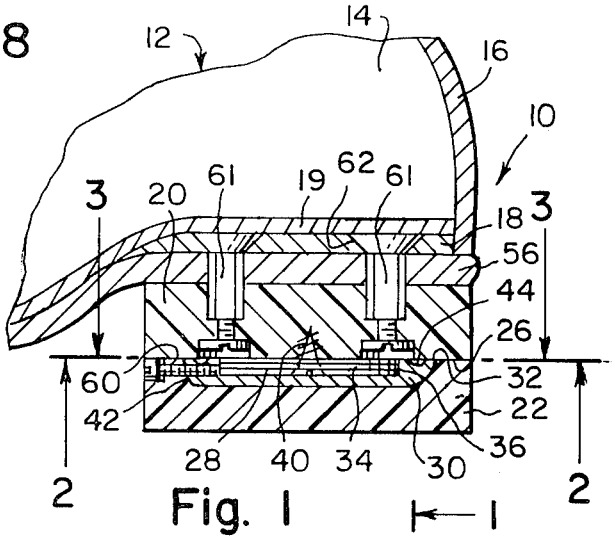
FIG. 1 is a side view of a man's shoe partially shown in section taken along line 1—1 of FIGS. 2, and 3 to illustrate the internal construction of the heel.

A side sectional view of the shoe replaceable heel device 10 according to the present invention as shown in FIG. 1. Also shown in FIG. 1 is a man's shoe 12, specifically, heel portion 14, which here includes heel back 16, sole 56, internal shoe liner 19 disposed over planer member 18, heel base 20, replaceable heel 22 and fastening means 61 for securing heel base 20 to sole 56, which will be explained in detail below.

In accordance with the present invention, a connecting means for removably screwing replaceable heel 22 to underside 26 of heel base 20 includes a preferable circular base plate 28 secured to underside 26 and a preferable circular replaceable plate 30 secured to top side 32 of replaceable heel 22. Base plate 28 is provide with a circular, externally threaded perimeter 34 and replaceable plate 30 is provided with internal screw threads 36 adapted to threadingly mate with threaded perimeter 34.

Opposite internal and external screw placements are of course possible from those shown and described in the preferred embodiment.

Figure 2:
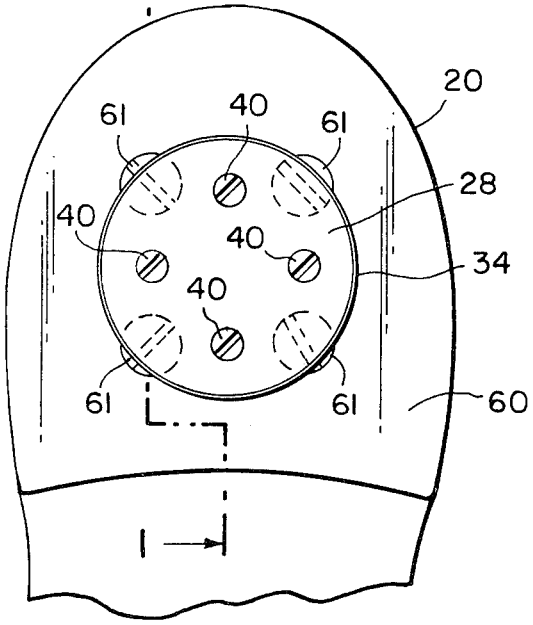
FIG. 2 is a view of the heel base plate taken along line 2—2 of FIG. 1.

Base plate 28 is secured to underside 26 of heel base 20, preferable as illustrated in the preferred embodiment of FIG. 2 by a plurality of screws, here shown as four screws 40, one of which is shown in section in FIG. 1. Screws 40 are suitable disposed around inner perimeter of base plate 28.

Threaded perimeter 34 of base plate 28 extends downward beyond underside 26 so as to expose the external screw threads 34 for mounting. The position of the screws is such that when the replaceable heel 22 is screwed onto heel base 20 the replaceable heel will be properly aligned when top side 32 of the replaceable heel is flush with underside 26 of heel base 20.

Figure 3:
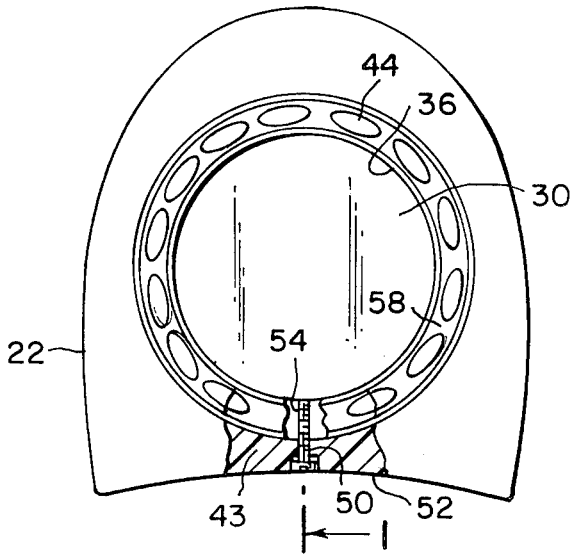
FIG. 3 is a view of the rubber heel replaceable unit taken along line 3—3 of FIG. 1 partially in section so as to illustrate the internal component construction thereof.
Figure 4:
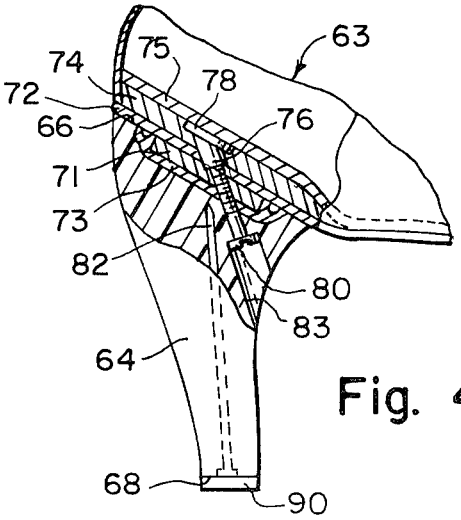
FIG. 4 is a partial side view of the replaceable high heel unit of a woman's shoe partially in section illustrating another embodiment of the invention.

As shown in FIGS. 2, 3 and 4, a circular concave groove 58 is formed about the outer perimeter portion of heel plate 30 while a circular concave or raised surface 60 is positioned about the outer perimeter portion of base plate 28 adapted to receive groove 58 so that the base plate and the replaceable plate are aligned when mounted together. Of course, the convex-concave configuration could be reversed.

Figure 8:
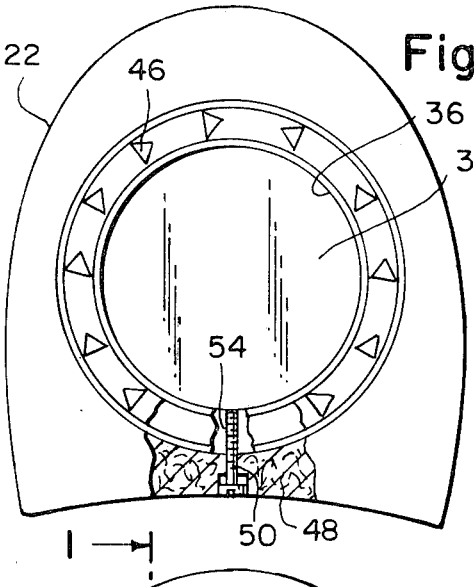
FIG. 8 is partial sectional view of the leather heel replaceable unit of an alternate embodiment to FIG. 3.

Replaceable plate 30 may in part be secured to heel 22, in particular a rubber, or suitable material heel 43, by embedding into recess 42 formed in the center portion of top side 32 of heel 22 as shown in FIGS. 1, 3 and 8 and or by conventional gluing (not shown) and conventional prong nails (not shown). In addition, a plurality of slats 44 are formed around the perimeter portion of the rubber heel replaceable plate 30 as shown in FIG. 3 in order to allow the rubber or suitable material of heel 22 to bleed into the slats during manufacture to provide additional holding strength between the heel and the rubber heel replaceable plate. FIG. 8 shows a variation of slats 44, in particular triangular punch slats for prong nails 46 that include conventional downwardly disposed prongs locking into leather heel 48 of FIG. 8. Also, for additional strength, a screw 50 extends substantially horizontally from the center of front wall 52 of heel 22 slightly below top side 32. Screw threads 54 adapted to receive screw 50 are formed through a portion of heel replaceable plate 30 as shown in FIGS. 1, 3 and 8 so that screw 50 fastens to and locks base plate 28 to replaceable heel 22, by preventing relative rotation between these two members.

A means for fastening heel base 20 to sole 56 as illustrated in FIG. 1 includes a planar member 18, preferably made of leather, which is shaped to conform to the heel of the shoe, is mounted in heel portion 14 under internal shoe liner 19. At least one RIVNUT® and preferably four RIVNUTS® 61, as shown in FIG. 2, two of which are shown in cross section in FIG. 1, are disposed from the top of planar member 18 which forms beveled recesses 62 to receive the flat head portion of the RIVNUTS®, through planar member 18 to a position in heel base 20, preferably adjoining underside 26 as illustrated where flanged head portions of the screws 61 are disposed in recesses formed at underside 26 and tightened. As shown in FIG. 1, internal shoe liner 19 is laid out over planar member 18.

As illustrated in FIG. 4, heel base 20 according to the present invention is applicable to a woman's high heel shoe 63. Heel base 20 is shown in FIG. 4 as a woman's replaceable high heel 64, which has an elongated vertical body with angeled upper side 66 and horizontal lower underside 68 which is much smaller in area than upper side 66. Upper side 66 is angled downwards towards toe at a preselected angle in accordance with the style of the woman's shoe. A planar member 74 mounted in high heel shoe under liner 75 is positioned over sole 72 and hex RIVNUT® 76 passes at an angle between an intermediate to the angle of female sole 72 and horizontal lower edge 68 so as to act to connect planar member 74 to sole 72 and sole 72 to high heel base 64 and in addition to provide support for the angled thrust placed upon the heel by the wearer. For this purpose, hex RIVNUT® 76 has a top flange stop 78 disposed at an angle with the longitudinal axis of a rivnut shaft 76 and parallel with said top side of sole 72 and an opposed flange screw head 80 disposed in heel base 64 so that the hex RIVNUT® acts as a jam nut against angled forces affecting the heel base. Screw head 80 is positioned within angled recess 83 in heel base 64.

Figure 5:
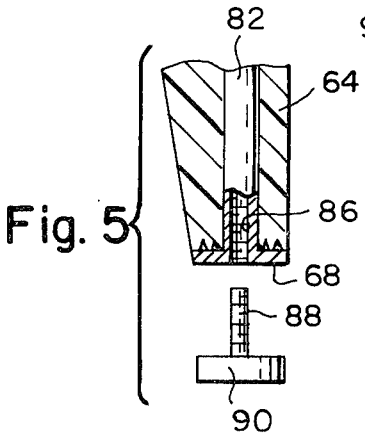
FIG. 5 is an enlarged cross-sectional view of the lift base plate of the heel tip of FIG. 4 illustrating the internal construction thereof.
Figure 7:
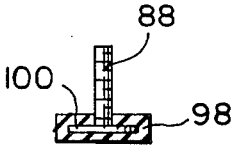
FIG. 7 is a detailed sectional view of the rubber lift replaceable unit of another embodiment of the heel lift illustrated in FIG. 5.

As shown in FIG. 5, high heel base 64 has a cental vertical stiffner 82 extending from underside 68 of the heel base upwards to a point intermediate in the heel base. A hole in stiffner 82 is adapted with lift base plate 68 to receive male screw insert 88. Male screw 88 with heel lift 90 is removably screwed into female screw threads 86. As also seen in FIG. 7, male screw 88 is provided with rubber or suitable material replaceable lift 98 secured to the head 100 of male screw 88. Heel lift 90 is a conventional replaceable lift for women's high heeled shoes that is analagous to replaceable heel 22 of the man's shoe described previously.

Angled single hex RIVNUT® 76 is analagous to the four vertical RIVNUTS® 61 described for the man's heel in FIGS. 1 and 2 above. For the woman's shoe, screw head 80 is directly reachable by a screw driver for assembly or disassembly purposes. When high heel base 64 is to be removed for replacement, screw head 80 is rotated and removed from hex RIVNUT® 76 to slide down and out of base 64. Thereupon base plate 71 which is analagous to base plate 28 in the man's shoe and which is mounted to the underside of sole 72 is unscrewed from replaceable plate 73 which is analagous to replaceable plate 30 of the man's shoe and which is mounted within base 64 along upper side 66. High heel base 64 is connected to the woman's shoe in a similar manner, that is by screwing replaceable plate 73 onto base plate 71 and mounting hex RIVNUT® 76 through planar member 74 and heel base 64 and screwing machine screw 80 into the hex RIVNUT®. It should be understood that the axis of rotation of screw 80, and the axis of rotation of heel plate 73 are purposely skewed so as to prevent rotation of the heel 64 with respect to the shoe 63 when screw 80 is in place and tight.

Figure 6:
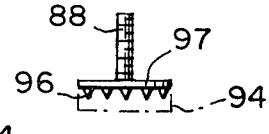
FIG. 6 is a detailed sectional view of the leather lift replaceable unit of one embodiment of the heel lift illustrated in FIG. 5.

FIGS. 6 and 7 show variations on details of the replaceable lifts, or heelets, 90. FIG. 6 illustrates a leather replaceable lift 94 jammed into mounting prongs 96 on a mounting plate 97 connected to screw 88 and FIG. 7 illustrates a rubber replaceable lift 98 connected to a mounting plate 100 that is also connected to screw 88. While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

RIVNUT® is a trademark of B. F. Goodrich Co. for Blind fastener.

What is claimed is:

1. A shoe replaceable heel device, in combination comprising:

a heel base mounted on the bottom of the heel portion of the sole of a shoe, said base having an underside, a replaceable heel, connecting means for removably screwing said replaceable heel to said underside of said base, and fastening means for securing said heel base to said sole, wherein said connecting means includes a circular base plate secured to said underside of said heel base and a circular replaceable plate secured to the top of said replaceable heel, said base plate having a male threaded perimeter and said replaceable plate having female screw threads adapted to mate with said threaded perimeter of said base plate, wherein said base plate extends downward from said heel base and said replaceable plate is embedded in said replaceable heel, wherein said sole has opposed top and bottom sides and wherein said fastening means includes a planar member disposed over said sole and at least one blind fastener nut disposed through said planar member, said sole, and said base heel, further including replaceable plate connecting means for securing said replaceable plate to said heel, said replaceable plate connecting means including a screw laterally extending from the inner side of said heel through said replaceable plate, wherein said circular replaceable plate forms a plurality of slats around the inner portion of the perimeter of said replaceable plate, said slats being adapted to receive said heel.

2. A shoe replaceable heel device according to claim 1, wherein said planar member is secured to said sole by at least one blind fastener connector, wherein said heel base is a female heel base having an extended body having an upper and lower sides, said upper side being disposed at an angle in relation to said lower side and connected to said heel portion of said sole, wherein said blind fastener has a top flange stop disposed at an angle with the longitudinal axis of a blind fastener shaft and parallel with said top side of said planar member and an opposed flanged screw head stop disposed in said heel base, whereby said blind fastener acts as a jam nut against angled forces affecting said heel base.

3. A shoe replaceable heel device according to claim 2, wherein said female heel base forms a vertical hole through said underside of said heel tip, said hole having a lift base plate with a female screw insert mounted therein and a male screw removably screwed into said female screw insert, said male screw being provided with a replaceable lift means secured to the mounting plate of said male screw for holding a replaceable lift for said female lift base plate.

* * * * *